US009963290B2

(12) United States Patent
Accursi

(10) Patent No.: US 9,963,290 B2
(45) **Date of Patent: *May 8, 2018**

(54) CAPSULE FOR MAKING BEVERAGES

(71) Applicant: CAFFITALY SYSTEM S.P.A., Gaggio Montano (BO) (IT)

(72) Inventor: Giovanni Accursi, Porretta Terme (IT)

(73) Assignee: CAFFITALY SYSTEM S.P.A., Gaggio Montano (IT)

( * ) Notice: Subject to any disclaimer, the term of this patent is extended or adjusted under 35 U.S.C. 154(b) by 261 days.

This patent is subject to a terminal disclaimer.

(21) Appl. No.: 14/763,600

(22) PCT Filed: Jan. 31, 2014

(86) PCT No.: PCT/IB2014/058706

§ 371 (c)(1),
(2) Date: Jul. 27, 2015

(87) PCT Pub. No.: WO2014/118743

PCT Pub. Date: Aug. 7, 2014

(65) Prior Publication Data

US 2015/0353275 A1 Dec. 10, 2015

(30) Foreign Application Priority Data

Feb. 4, 2013 (IT) ..... VR2013A0026
Jun. 21, 2013 (WO) ..... PCT/IB2013/055105
Jul. 18, 2013 (IT) ..... VR2013A0168

(51) Int. Cl.
*B65D 85/804* (2006.01)

(52) U.S. Cl.
CPC ..... *B65D 85/8043* (2013.01); *B65D 85/8046* (2013.01)

(58) Field of Classification Search
CPC ..... B65D 85/8043
See application file for complete search history.

(56) References Cited

U.S. PATENT DOCUMENTS 4,853,234 A 8/1989 Bentley et al.
6,645,537 B2 11/2003 Sweeney et al.
(Continued)

FOREIGN PATENT DOCUMENTS

DE 102009007553 8/2010
EP 1837294 9/2007
(Continued)

*Primary Examiner* — Erik Kashnikow
*Assistant Examiner* — Chaim A Smith
(74) *Attorney, Agent, or Firm* — Pearne & Gordon LLP

(57) ABSTRACT

A capsule for making beverages comprising at least one powdered food substance which can be extracted using water to make a beverage, comprising a cup-shaped outer body (2) with a lower wall (3) and a first side wall (4), a lid (6), a filtering body (9) comprising a first rigid or semi-rigid skeleton (10); the first rigid or semi-rigid skeleton (10) comprising openings (13); the capsule also comprising an additional filtering element (26) positioned in the chamber (7) between the filtering body (9) and the lower wall (3) for in use intercepting the beverage which comes out of the filtering body (9) and flows towards the lower wall (3), the additional filtering element (26) comprising at least one layer (27) of flexible filtering material and being coupled to the inner part of the outer body (2).

54 Claims, 10 Drawing Sheets

(56) References Cited

U.S. PATENT DOCUMENTS

| | | | | |
|---|---|---|---|---|
| 8,535,743 | B2 | 9/2013 | Kamerbeek et al. | |
| 2002/0020659 | A1 | 2/2002 | Sweeney et al. | |
| 2005/0051478 | A1 | 3/2005 | Karanikos et al. | |
| 2006/0219098 | A1 | 10/2006 | Mandralis et al. | |
| 2007/0148290 | A1* | 6/2007 | Ternite ..... | B65D 85/8043 426/90 |
| 2009/0205504 | A1 | 8/2009 | Navarro Alcantara | |
| 2010/0288131 | A1 | 11/2010 | Kilber et al. | |
| 2010/0303964 | A1 | 12/2010 | Beaulieu et al. | |
| 2011/0073607 | A1 | 3/2011 | Fu et al. | |
| 2011/0303095 | A1 | 12/2011 | Fu et al. | |
| 2012/0097602 | A1 | 4/2012 | Tedford | |
| 2012/0171333 | A1 | 7/2012 | Crump et al. | |
| 2012/0201933 | A1 | 8/2012 | Dran | |
| 2012/0225168 | A1 | 9/2012 | Kamerbeek et al. | |
| 2012/0231123 | A1 | 9/2012 | Kamerbeek et al. | |
| 2012/0231124 | A1 | 9/2012 | Kamerbeek et al. | |
| 2012/0251694 | A1 | 10/2012 | Kamerbeek et al. | |
| 2013/0333575 | A1 | 12/2013 | Kamerbeek et al. | |
| 2014/0010926 | A1 | 1/2014 | Digiuni | |
| 2014/0053735 | A1 | 2/2014 | Verbeek et al. | |
| 2014/0287105 | A1 | 9/2014 | Husband et al. | |

FOREIGN PATENT DOCUMENTS

| | | | |
|---|---|---|---|
| EP | 1867585 | | 12/2007 |
| JP | S55166122 | A | 12/1980 |
| JP | H10179402 | A | 7/1998 |
| WO | 0160712 | A1 | 8/2001 |
| WO | 2010128844 | | 11/2010 |
| WO | 2012121597 | | 9/2012 |
| WO | 2013043048 | A1 | 3/2013 |

* cited by examiner

CAPSULE FOR MAKING BEVERAGES

This invention relates to a capsule for making beverages. In particular reference is made to those capsules comprising an outer body and a lid which closes the top of the outer body and in which a powdered food substance (for example coffee powder) is positioned, which can be extracted by passing water (which may be pressurised) through it to make a beverage, for example coffee. More specifically reference is made to those capsules in which the outer body comprises a lower wall and a side wall which form a chamber in which a rigid or semi-rigid filtering body is positioned.

In more detail, reference is made to those capsules suitable for use in beverage making systems in which the capsule is pierced at the lid, to allow the injection of water (which may be pressurised) into the capsule itself, and at the lower wall, to allow dispensing outside the capsule of the beverage produced by the interaction of the water with the powdered food substance.

In such capsules the filtering body is substantially a flat filtering body, normally disk-shaped, positioned close to the lower wall of the capsule outer body and separates the powdered food substance from the lower wall in such a way that powder does not come out of the capsule after a piercing element has penetrated through the lower wall. In fact, the filtering body on one hand allows the beverage to pass through it in such a way that said beverage can come out of the capsule through the lower wall (through a hole made by the piercing element or through a channel present in the latter), and on the other hand allows the powdered food substance to be retained inside the capsule.

However, this prior art technology may have several disadvantages under certain circumstances.

In particular, with some types and particle sizes of the powdered food substance, and when dispensing relatively large quantities of beverage (such as American coffee), the prior art capsules may not allow optimum extraction of the powdered food substance.

In fact, first, when the powdered substance is milled in a way that is not suitable and contains too much powder which is below a predetermined particle size, it is possible that powder will come out in the beverage, with a consequent deterioration of the quality of the beverage (even if, as is known, an extremely small quantity of powder coming out is substantially normal when preparing beverages of this type, particularly coffee).

Second, when dispensing relatively large quantities for a single beverage (for example, when making American coffee), dispensing times may be relatively long for consumer demands.

Furthermore, especially in the case of capsules which contain relatively large quantities of powder (intended for the production of relatively large quantities of beverage), the beverage made by the interaction between the water and the powder located close to the lid, in order to be able to come out of the capsule must reach the filtering body and therefore must pass through all of the powder below which may obstruct its path. In fact, once moistened with the water, the powdered food substance tends to become compacted, obstructing the flow of the liquids which encounter increased resistance to permeation through the powder.

In fact, the water injected into the capsule tends to cause compacting of the powdered food substance at the filtering body, therefore increasing the resistance of the powdered food substance to the passage of liquids through it and resulting in difficulties draining the beverage through it.

Moreover, during the injection of water into the capsule, areas are created in the powder which are compacted to different degrees. Therefore, large prior art capsules have the disadvantage that the powdered food substance can only be permeated unevenly, that is to say, to drastically different degrees depending on the position of the powdered food substance in the capsule. Moreover, in prior art capsules, since the water tends to flow in the zones of the powder which are less resistant to permeation, preferential channels for the passage of the water are easily created, the result being that the powdered food substance is not all permeated homogeneously.

A solution which overcomes the latter disadvantage is described in Italian patent application No. VR2012A000133 and in the corresponding U.S. patent application Ser. No. 13/549,904 by this Applicant, whose content had still not be disclosed at the time this patent application was filed.

In this case, the disk-shaped filter was replaced by a basket-shaped rigid or semi-rigid filter having openings in its side wall, which is spaced from the inner part of the side wall of the outer body. Thanks to this solution it was practically possible to avoid the various clogging problems which in contrast may occur with prior art capsules.

However, even this solution did not allow the other possible disadvantages indicated above to be overcome.

Finally, there are also some prior art capsules in which in place of a flat rigid or semi-rigid filter, there is a conical or frusto-conical filter formed by a layer of flexible material. However, even these capsules have significant disadvantages.

In particular, if relatively large quantities of beverage are dispensed, such as American coffee, when the powder gets wet it tends to become compacted on the bottom of the filter, substantially clogging it. At that point the extraction water can no longer penetrate the powder and tends to bypass it, coming out of the filter laterally, above the powder, therefore without any extraction taking place. The resulting beverage is therefore of poor quality.

In this context, the technical purpose which forms the basis of this invention is to provide a capsule for making beverages which overcomes the above-mentioned disadvantages.

In particular, the technical purpose of this invention is to provide a capsule for making beverages which allows the risk of powder coming out with the beverage to be minimised.

The technical purpose of this invention is also to provide a capsule for making beverages which also allows the dispensing of relatively large quantities of beverage in a relatively shorter time.

It is also the technical purpose of this invention to provide a capsule for making beverages which allows the water fed in to permeate the powdered food substance more evenly than the prior art capsules.

It is also the technical purpose of this invention to provide a capsule for making beverages which allows limitation, compared with prior art capsules, of the risk of forming highly compacted zones, in the powdered food substance, which could obstruct the flow of the beverage, and/or of preferential channels for the passage of the water.

The technical purpose specified and the aims indicated are substantially achieved by a capsule for making beverages as described in the appended claims.

Further features and the advantages of this invention are more apparent in the detailed description below, with reference to several preferred, non-limiting embodiments of a capsule for making beverages, illustrated in the accompanying drawings, in which.

Figure 1:
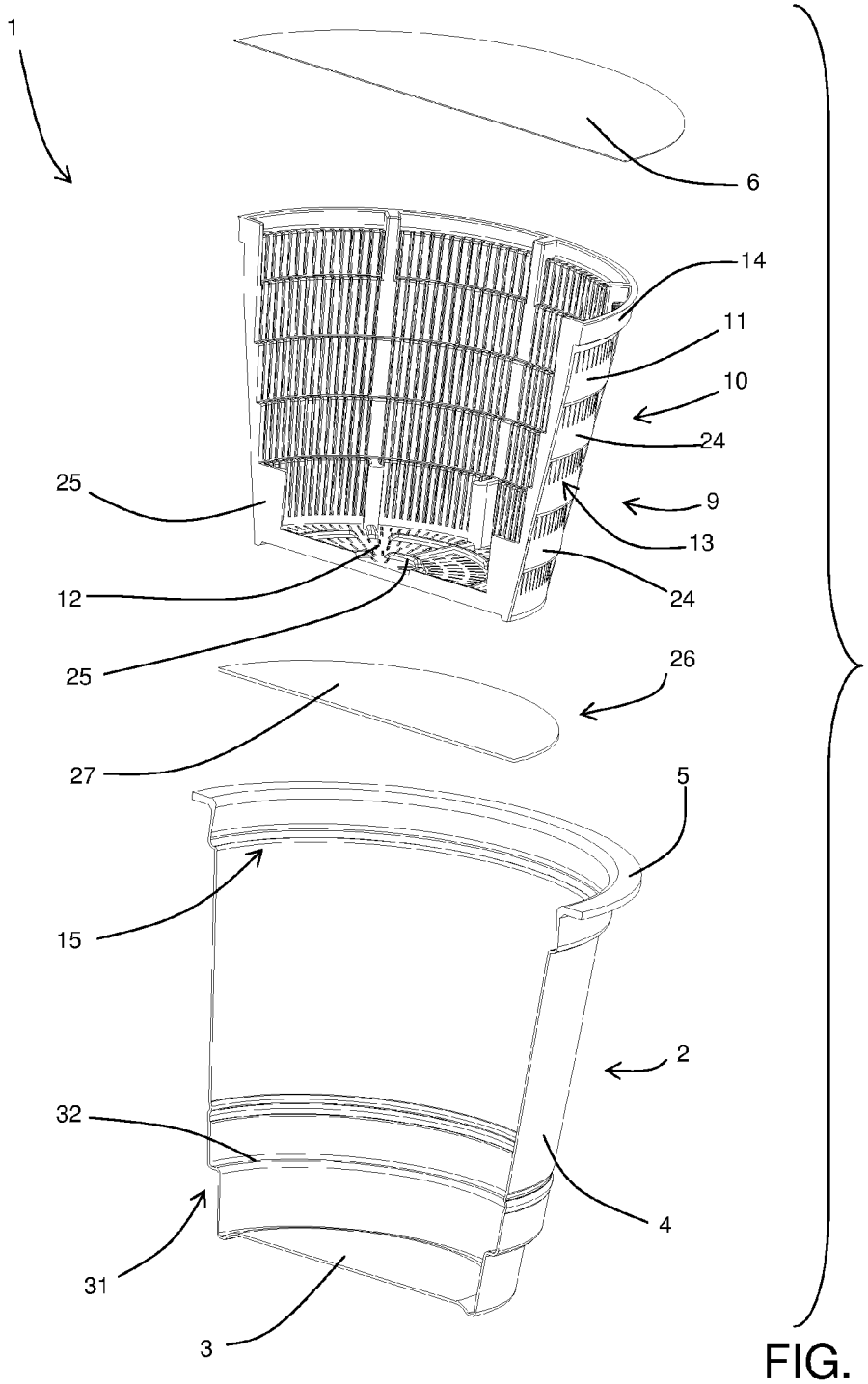
FIG. 1 is a schematic axonometric exploded view of a capsule made in accordance with a first embodiment of this invention, in cross-section along a vertical middle plane.

With reference to the accompanying drawings, the numeral 1 denotes in its entirety a capsule for making beverages in accordance with this invention.

As indicated, this invention relates to a capsule 1 for making beverages comprising at least one powdered food substance (not illustrated in the accompanying drawings) which can be extracted by passing water through it to make a beverage. The powdered food substance, for example powdered coffee, can be extracted for example by infusion or is soluble to make a beverage such as coffee or tea, infusions, soups, etc. The capsule 1 may be suitable for allowing extraction of the powdered food substance, such as coffee, by passing pressurised water through it, for example to make an espresso coffee.

The capsule 1 comprises a substantially cup-shaped outer body 2 which in turn comprises a lower wall 3 and a first side wall 4. In the embodiments illustrated the lower wall 3 of the capsule 1 mainly extends in a disk-shaped fashion and the first side wall 4 extends from it with a shape that to a first approximation is frusto-conical, the upper part of it ending with an upper edge 5 located on the opposite side to the lower wall 3. A lid 6 is fixed to the outer body 2 at the upper edge 5 and closes the top of the outer body 2. The outer body 2 and the lid 6 of the capsule 1 may each be made of different materials. The outer body 2 may, for example, be made of a plastic material whilst the lid 6 may be made of an aluminium sheet (both may consist of a single layer or multiple layers). Inside the outer body 2, between the lid 6 and the inner surface of the outer body 2, there is a chamber 7 in which, during use of the capsule 1, the beverage is formed after interaction between the powdered food substance and the water. Between a central point of the lid 6 and a central point of the lower wall 3 there is an axis of extension 8 of the capsule 1, visible in FIGS. 2, 3 and 4. In all of the embodiments illustrated the capsule 1 is symmetrical relative to the axis of extension 8.

Advantageously, in the embodiments illustrated, the capsule 1 is sealed in a watertight fashion, but in use the lid 6 can be pierced to allow water to be injected into the capsule 1 and the lower wall 3 can also be pierced to allow the beverage to come out of the capsule 1. Therefore, hereinafter reference will preferably be made to this embodiment. However, other embodiments are possible, in which the lid 6 and/or the lower wall 3 are themselves capable of allowing the water and the beverage to pass (for example because they are pre-pierced or permeable).

The capsule 1 is therefore suitable for use in a beverage making system which advantageously comprises a housing in which the capsule 1 can be inserted for use for making a beverage, for example coffee. A system suitable for using the capsule 1 illustrated comprises, in the substantially known way, means for injecting water into the capsule 1, which can be associated with the lid 6, comprising an injecting element such as a needle or a blade if necessary comprising a channel for the passage of the water, and it also comprises means for extracting the beverage from the capsule 1, which can be associated with the lower wall 3, said means in turn comprising a piercing element for piercing/penetrating the lower wall 3 of the capsule 1 outer body 2. In this context, the term piercing element refers to any element, substantially of the known type, able to pierce, cut or tear, for example a spike or a blade, fixed or mobile (again, if necessary forming a channel for the passage of the water). The piercing element can also pass through the lower wall 3 of the capsule 1 centrally or, preferably, off-centre.

The capsule 1 also comprises a filtering body 9, positioned in the chamber 7, able to allow the passage of beverage through it and at the same time to substantially retain the powdered food substance so that, during use of the capsule 1, the beverage can pass through the filtering body 9 and then come out of the capsule 1 (for example through a hole made by the piercing element in the lower wall 3 or through a channel made in the piercing element), whilst the powdered food substance can remain substantially trapped inside.

In general, the filtering body 9 comprises a first rigid or semi-rigid skeleton 10 positioned in the chamber 7 which comprises a substantially annular rim 14 and openings 13 to allow fluid communication through it. The rim 14 is coupled to the outer body 2 at a substantially annular coupling portion 15 of the first side wall 4. The filtering body 9 divides the chamber 7 into a first compartment 16 positioned at least between the filtering body 9 and the lid 6, for receiving the powdered food substance, and into a second compartment 17 positioned between the filtering body 9 and the lower wall 3. In the preferred embodiment the piercing element, during use, can penetrate the lower wall 3 and be inserted in the second compartment 17 without damaging the filtering body 9. In contrast, a piercing injecting element may pass through the lid 6 and be inserted directly in the first compartment 16.

The first rigid or semi-rigid skeleton 10 may have any shape depending on requirements. For example, the accompanying drawings show three alternative embodiments of it, one in which the first rigid or semi-rigid skeleton 10 is basket-shaped, and two in which it has a more traditional shape. Hereinafter, the former type is described first, followed by the others.

However, it shall be understood that what is described relative to one embodiment is also applicable to the others if compatible.

According to the first type illustrated in FIGS. 1 to 12, the first rigid or semi-rigid skeleton 10 is basket-shaped, contains the powdered food substance, and in turn comprises a second side wall 11 and a bottom portion 12. The latter may in any case also be constituted exclusively of a lower edge of the second side wall 11. Advantageously, the openings 13 are made at least through the second side wall 11. Depending on the embodiments, they may or may not also be made through the bottom portion 12 (as in the cases illustrated in the accompanying drawings).

The second side wall 11 comprises its own substantially annular upper rim and the bottom of the second side wall is connected to the bottom portion 12. In these embodiments, the upper rim of the second side wall 11 coincides with the already defined rim 14 of the first rigid or semi-rigid skeleton 10.

Therefore, hereinafter, the rim 14 and the upper rim will both be identified with the same reference number 14.

In the assembled capsule 1, the upper rim 14 is positioned close to the lid 6 of the capsule 1 (they may or may not be in contact) and is coupled to the outer body 2 at the coupling portion 15 of the first side wall 4, which in turn is located close to the upper edge 5 of the first side wall 4. Therefore, advantageously, the upper rim 14 of the filtering body 9 also has a substantially annular extension about the axis of extension 8. In any case, the coupling between the filtering body 9 and the capsule 1 outer body 2 is described in more detail below.

The bottom portion 12 is in contrast positioned close to the lower wall 3 of the outer body 2, although it is possible that there is a certain distance between the two, for the reasons explained below.

Advantageously, as shown in FIGS. 1 to 11, the upper rim 14 of the filtering body 9 substantially delimits an access aperture to the first compartment 16 which in the embodiments illustrated is substantially circular. Therefore, the filtering body 9 is advantageously open at the top, that is to say, on the side facing towards the lid 6. During capsule 1 production, when the lid 6 is separate from the outer body 2, the powdered food substance can therefore be inserted in the first compartment 16 by simply pouring it into said compartment (through the access aperture in the embodiment in FIGS. 1 to 12).

Figure 13:
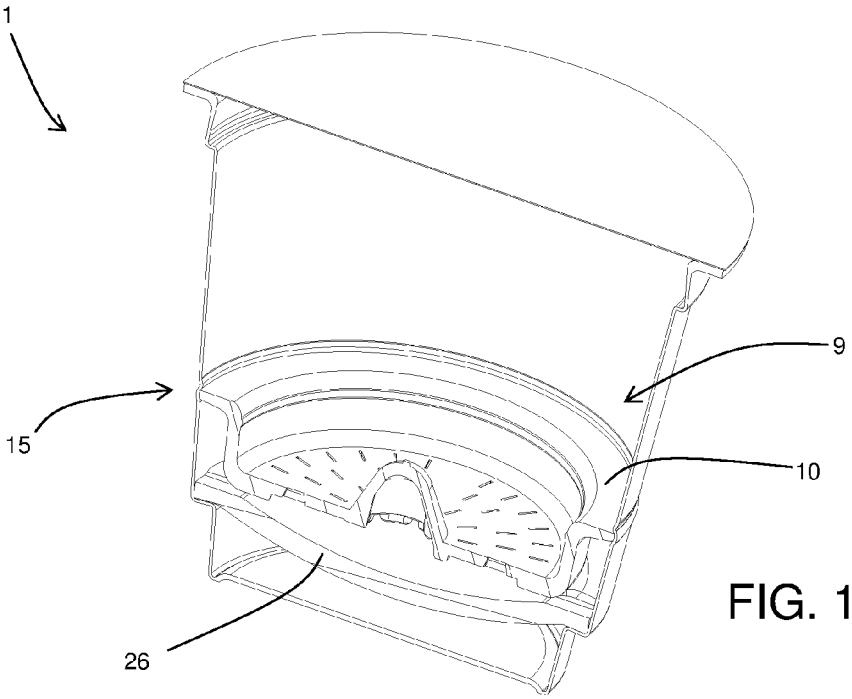
FIG. 13 is a schematic axonometric view of a capsule made in accordance with a sixth embodiment of this invention, in cross-section along a vertical middle plane.
Figure 12:
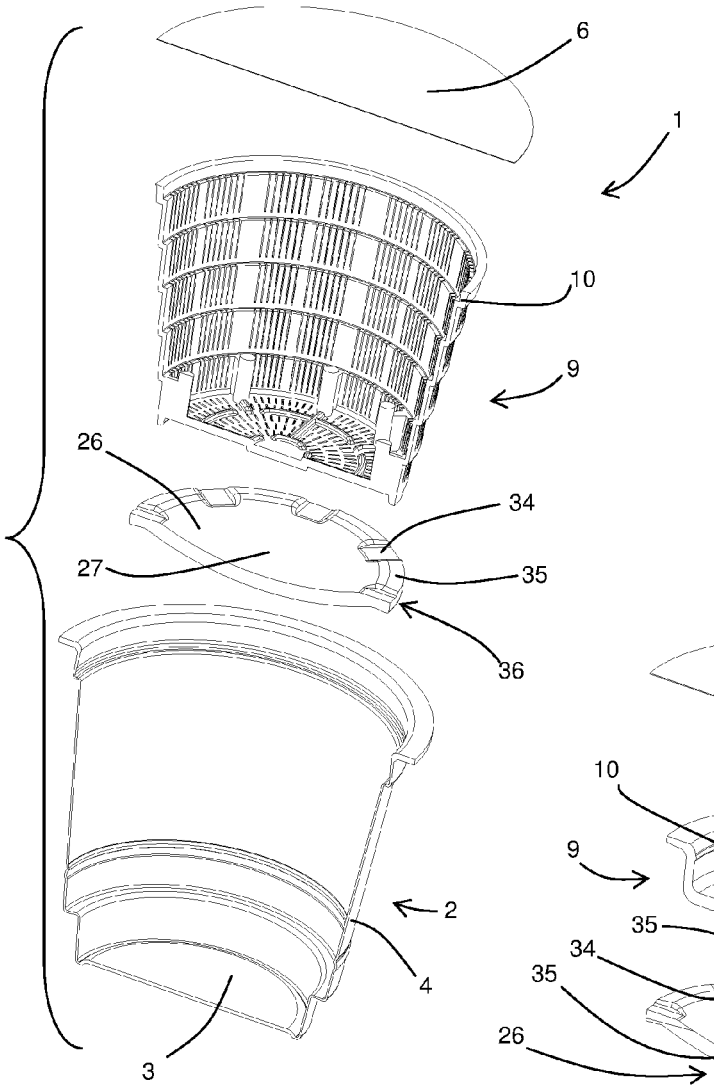
FIG. 12 is an axonometric exploded view of the capsule of FIG. 11.
Figure 15:
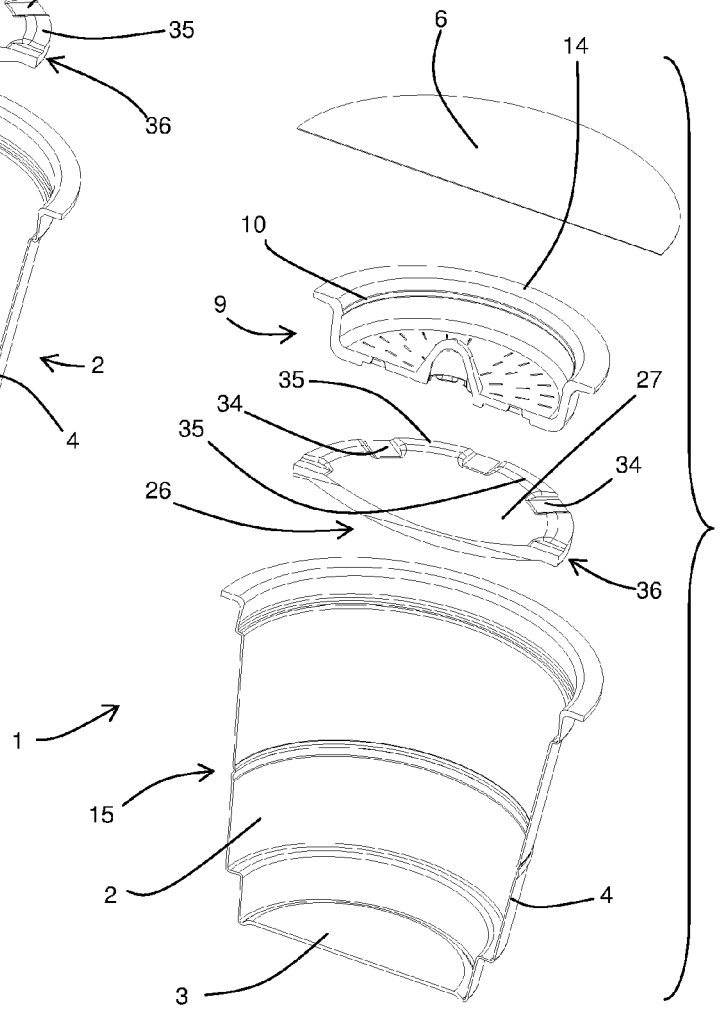
FIG. 15 is an axonometric exploded view of the capsule of FIG. 14.
Figure 14:
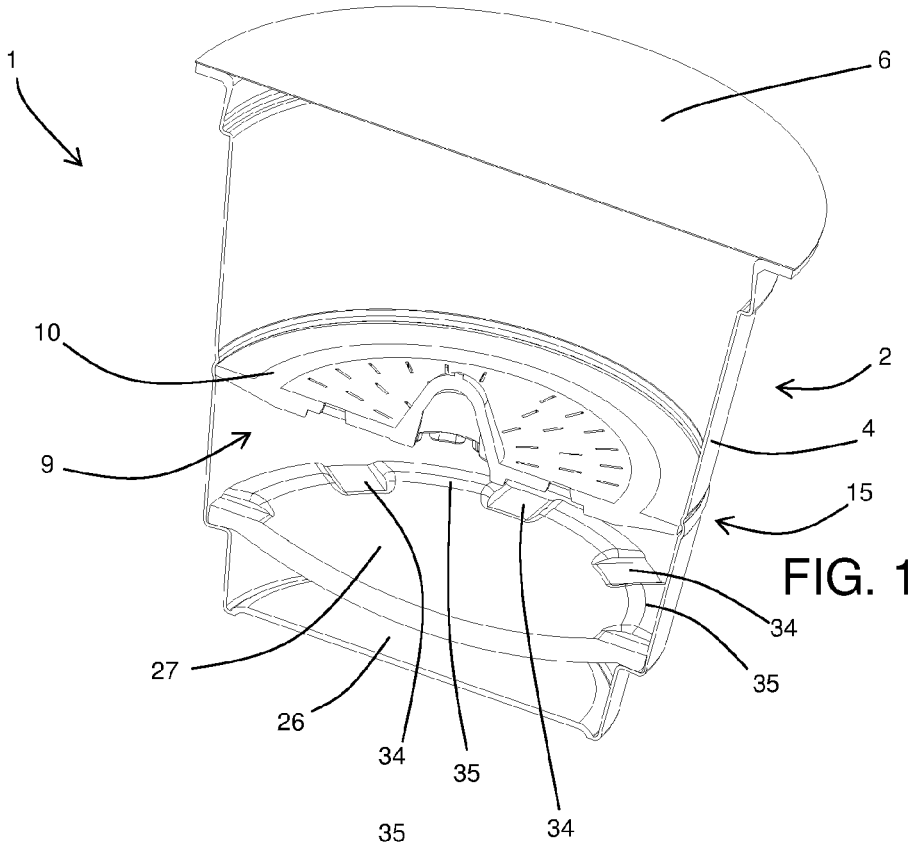
FIG. 14 is a schematic axonometric view of a capsule made in accordance with a seventh embodiment of this invention, in cross-section along a vertical middle plane.

FIGS. 13 to 15 in contrast show two different possible embodiments of the first rigid or semi-rigid skeleton 10 (which are known and not therefore described in detail).

In the case of FIG. 14 it is substantially disk-shaped, whilst in the case of FIG. 13 it is bowl-shaped with an annular side connecting shoulder and reduced height. In the first compartment 16 the powered food substance interacts with the water injected into the capsule 1 to make the beverage. In contrast, the second compartment 17 is intended, during use, to receive the beverage made in the first compartment 16 and which comes out of the latter through the filtering body 9.

In general, the first compartment 16 is delimited at least between the filtering body 9 and the lid 6. However, in many preferred embodiments the first compartment 16 may also be delimited by an annular portion of the first side wall 4 located between the upper edge 5 of the first side wall 4 itself and the coupling portion 15 (which, as indicated, is for example close to the upper edge 5 in the embodiments in FIGS. 1 to 12, but far from it in the embodiments in FIGS. 13 to 15).

In the embodiments in FIGS. 1 to 12, the first compartment 16 is therefore at least mainly delimited by the filtering body 9, and advantageously extends over most of the volume of the chamber 7. According to this invention, again in said embodiments, the second side wall 11 is at least partly spaced from the first side wall 4 (being side by side with and opposite to it) for allowing the beverage to flow between them towards the lower wall 3. Advantageously, the openings 13 through the second side wall 11 are made at least at the part of the second side wall 11 which is spaced from the first side wall 4. In this way, the openings 13 allow a reduction, compared with capsules which do not have a basket-shaped filtering element 9, in the average distance that the water must cover through the powdered food substance in order to be able to come out of the filtering body 9 in the form of the beverage, with the advantage that the water encounters less resistance to its passage through the substance. Consequently, in particular in the case of capsules containing relatively large quantities of powdered substance, the basket-shaped filtering body 9 allows improved filtering of the beverage, a reduced tendency of the powdered food substance to become unevenly compacted and therefore more even permeation of the powdered food substance by the water injected into the capsule 1.

In general, the second compartment 17 is delimited between the filtering body 9, the lower wall 3 and the portion of the first side wall 4 located between the lower wall 3 and the coupling portion 15.

Moreover, in the embodiments in FIGS. 1 to 12 the second compartment 17 partly extends between the first side wall 4 and the second side wall 11. In other words, the second compartment 17 surrounds at least part of the filtering body 9. In particular, the second compartment 17 extends along the first side wall 4 at least for most of the distance, measured parallel to the axis of extension 8, between the coupling portion 15 and the lower wall 3, and therefore surrounds the filtering body 9 over most of its extension parallel to the axis of extension 8.

Even more advantageously, as in the embodiments illustrated in the accompanying drawings, FIGS. 1 to 12, the second compartment 17 extends along the first side wall 4 to the coupling portion 15. Since the filtering body 9 is coupled to the coupling portion 15 at the upper rim 14, the substantial totality of the filtering body 9 is surrounded by the second compartment 17. Advantageously, the openings 13 are distributed over the entire part of the filtering body 9 surrounded by the second compartment 17, and in particular over the entire part of the second side wall 11 which is opposite the second compartment 17. In said embodiments, advantageously, the openings 13 are evenly distributed around the filtering body 9 and are grouped together in groups which are in turn substantially distributed in an even way along the extension of the second side wall 11 between the upper rim 14 and the bottom portion 12.

Therefore, advantageously, all of the openings 13 made in the second side wall 11 are located at a height which is lower than the maximum height reached by the powdered substance in the first compartment 16 (where the height is measured relative to the lower wall 3), in such a way as to prevent the water from reaching the openings 13 without having to pass through the powdered substance.

As already indicated, the filtering body 9 is coupled to the first side wall 4 at the coupling portion 15. The coupling may be made in various ways.

Figure 2:
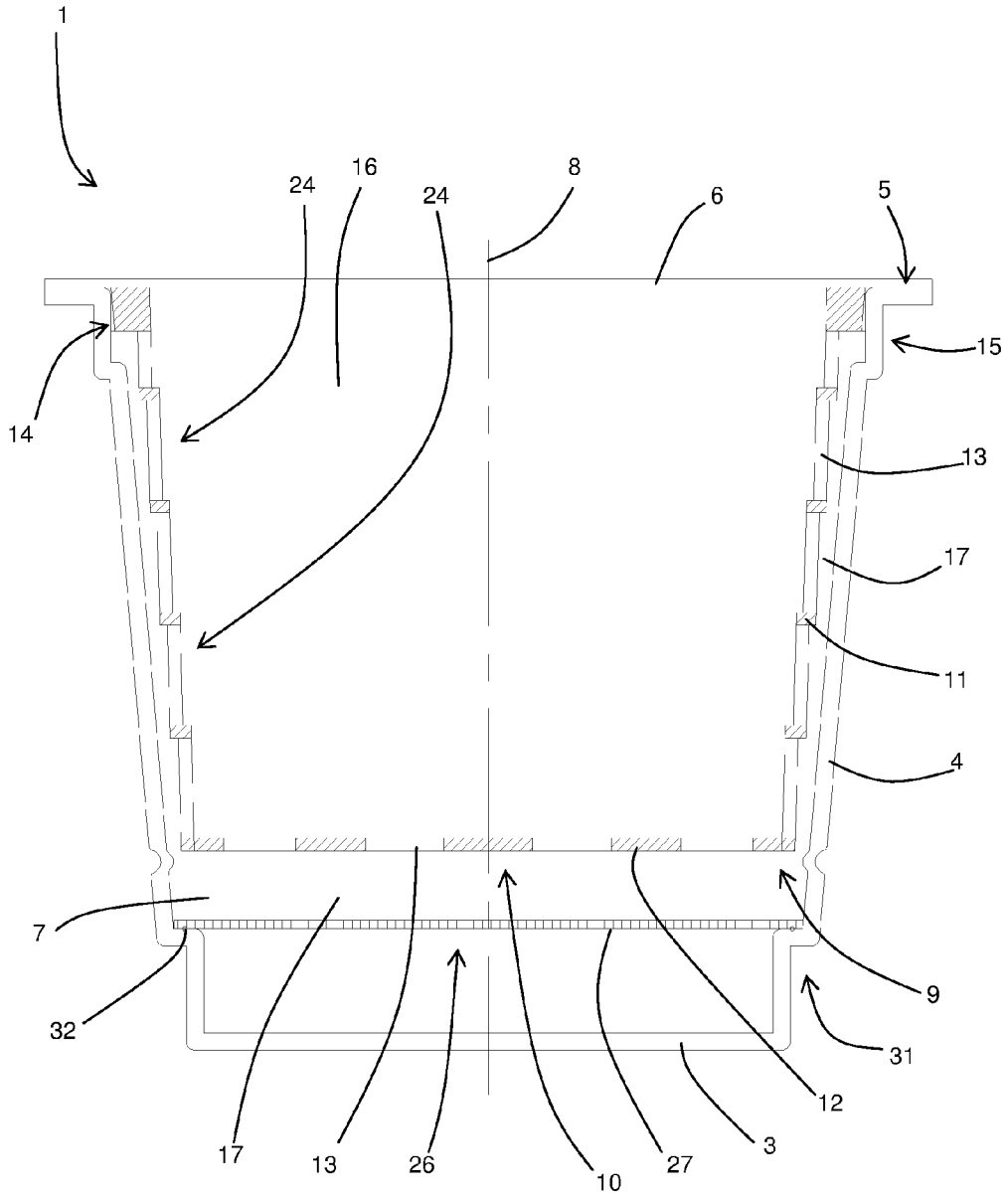
FIG. 2 is a schematic vertical middle cross-section of a capsule made in accordance with a second embodiment of this invention, similar to the first embodiment; it should be noticed that for greater clarity FIG. 2 only shows the details visible in the cross-section plane and not those in the background.
Figure 3:
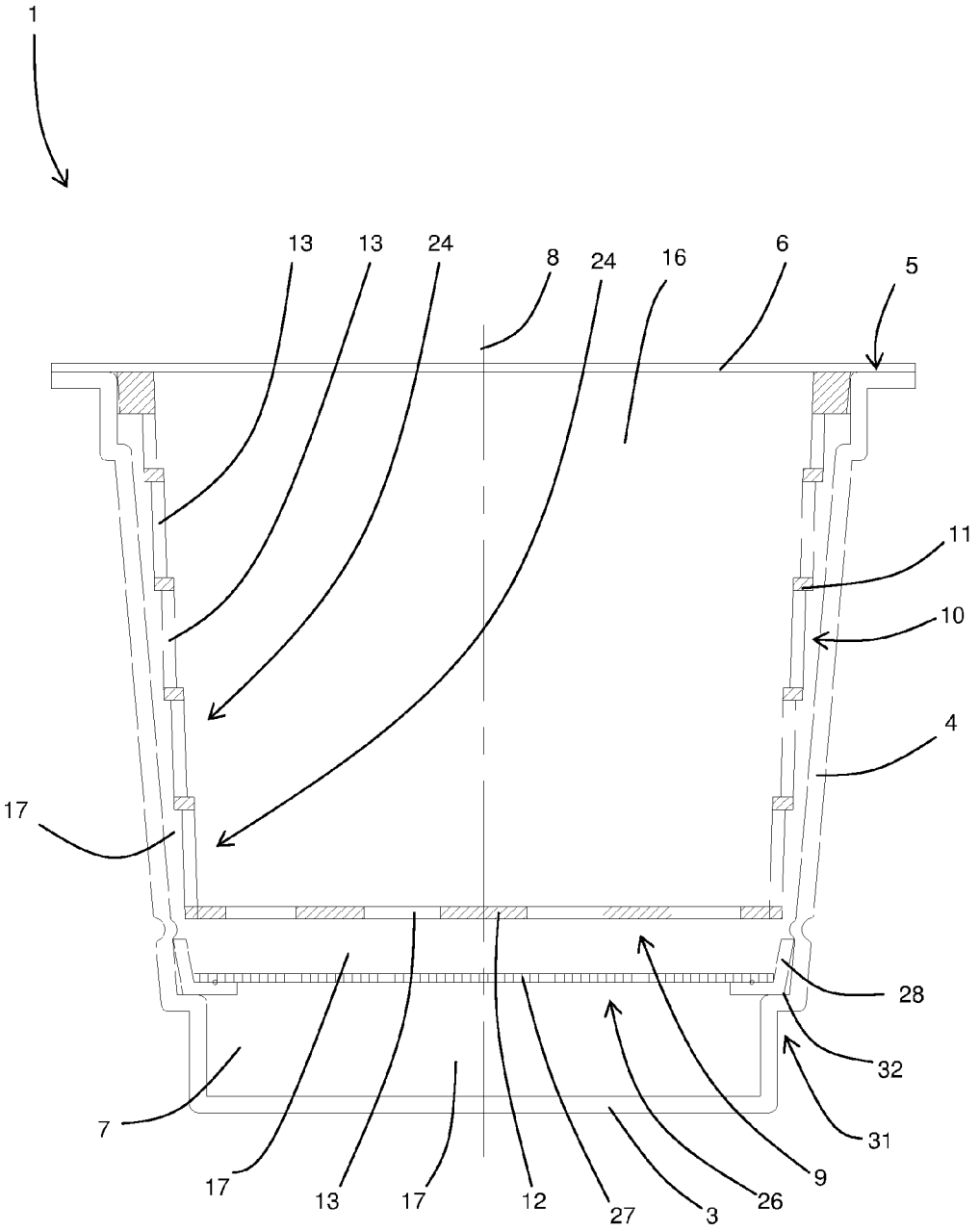
FIG. 3 is a schematic vertical middle cross-section of a capsule made in accordance with a third embodiment of this invention; it should be noticed that for greater clarity FIG. 3 only shows the details visible in the cross-section plane and not those in the background.
Figure 4:
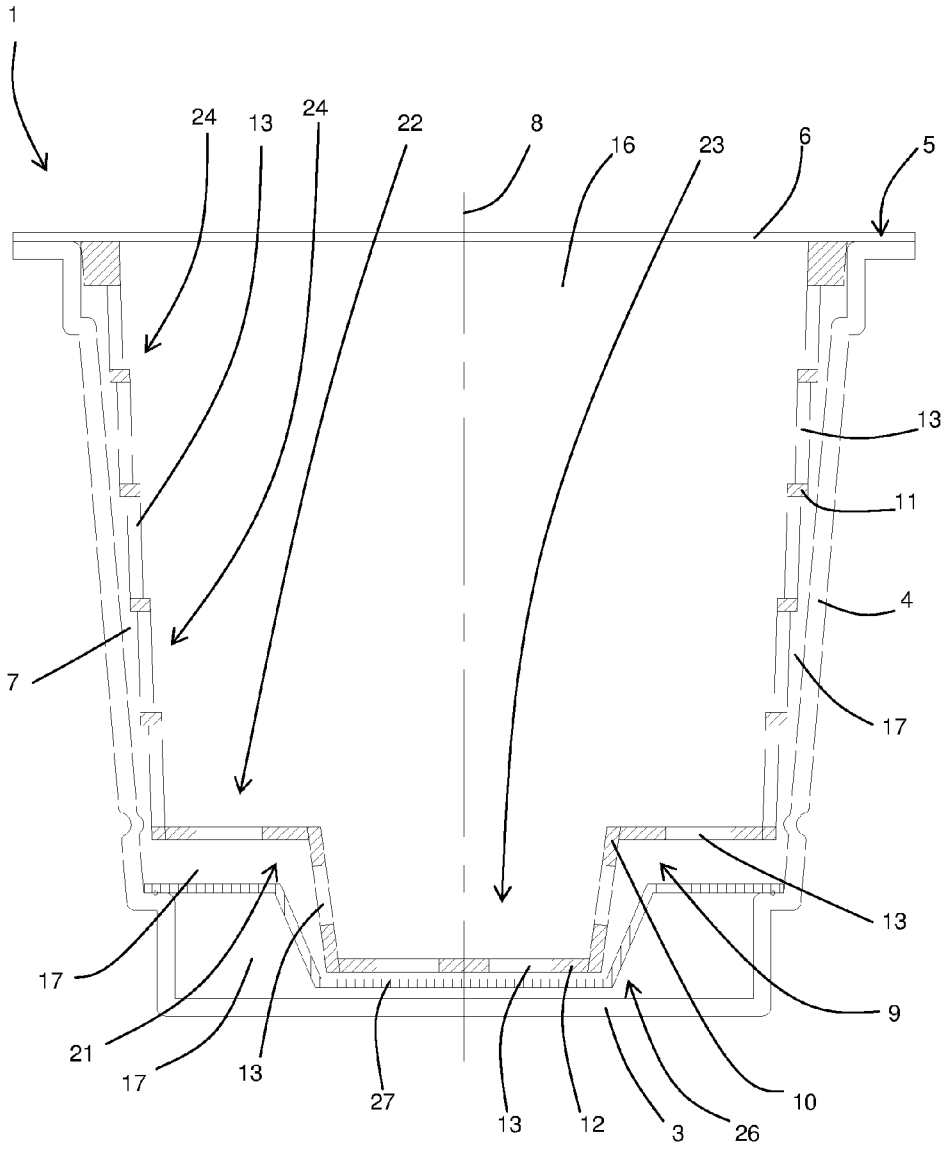
FIG. 4 is a schematic vertical middle cross-section of a capsule made in accordance with a fourth embodiment of this invention; it should be noticed that FIG. 4 also only shows the details visible in the cross-section plane and not those in the background.

In the case in FIGS. 2, 3 and 4 the coupling is only schematically illustrated with the upper rim 14 positioned substantially adjacent to the lid 6.

Figure 10:
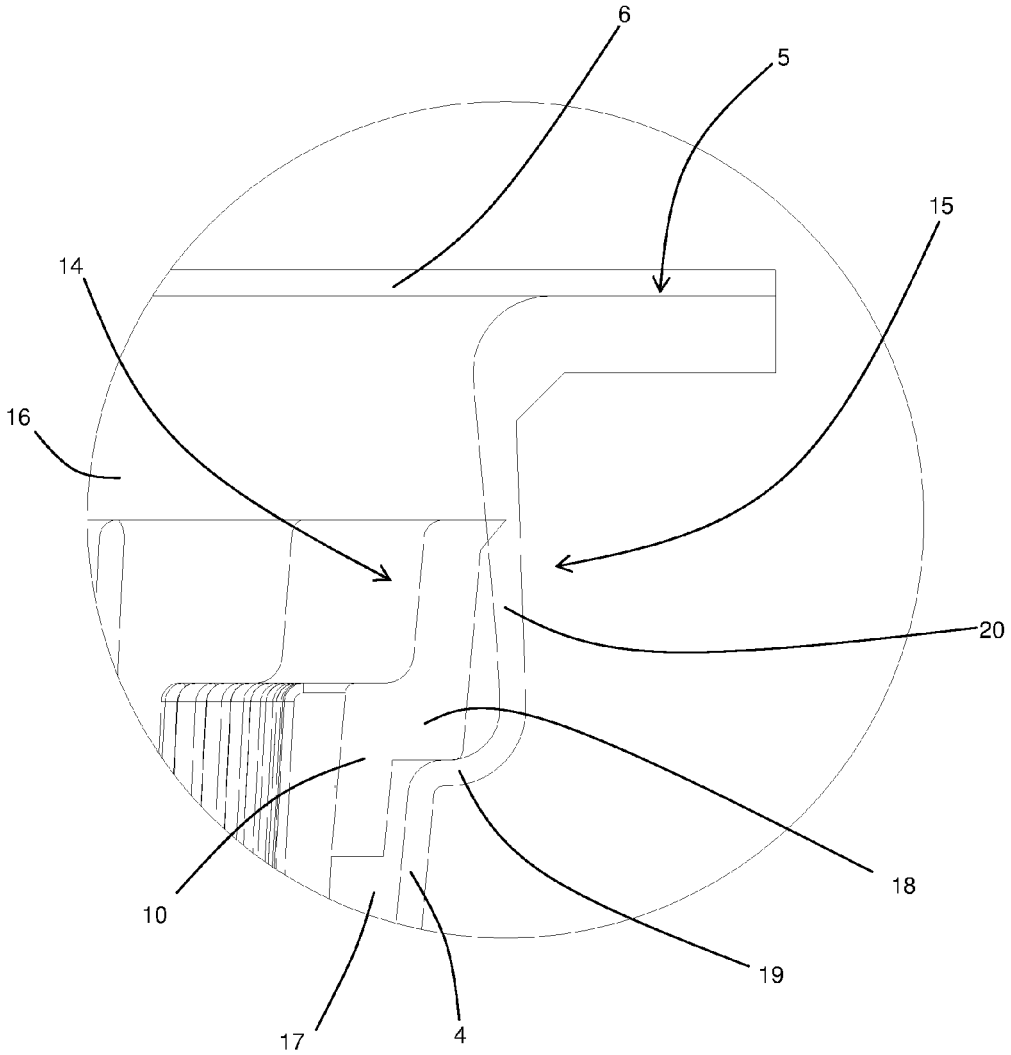
FIG. 10 is a schematic vertical middle cross-section of a detail of the capsule of FIG. 1 in an assembled configuration.
Figure 11:
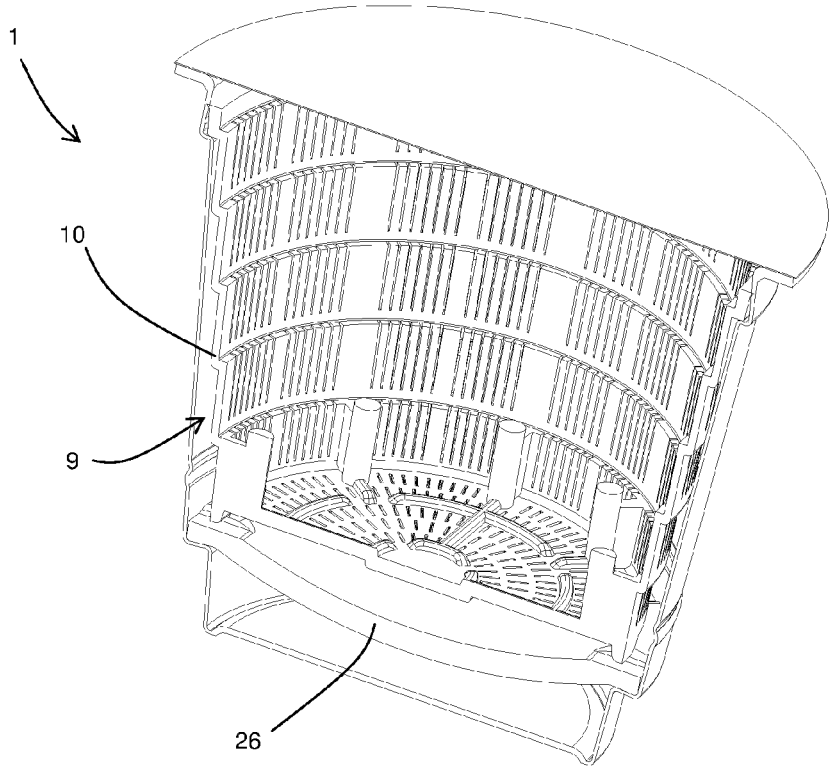
FIG. 11 is a schematic axonometric view of a capsule made in accordance with a fifth embodiment of this invention, in cross-section along a vertical middle plane.

In contrast, a preferred embodiment in the case of the basket-shaped first rigid or semi-rigid skeleton 10, is illustrated in the detail in FIG. 10, where the first rigid or semi-rigid skeleton 10 of the filtering body 9 comprises a shoulder 18, close to the upper rim 14, with substantially annular extension about the axis of extension 8 and projecting radially relative to the rest of the filtering body 9 (again with reference to the axis of extension 8). In other words, seen in a cross-section plane passing through the axis of extension 8, the first rigid or semi-rigid skeleton 10 externally comprises an inverted step close to the upper rim 14. The filtering body 9 advantageously rests on the coupling portion 15 by means of the shoulder 18. In fact, in the preferred embodiment illustrated, the coupling portion 15 comprises a counter-shoulder 19 which also has substantially annular extension about the axis of extension 8 and which projects radially, with reference to the axis of extension 8, relative to the portion of the first side wall 4 adjacent to it on the lower wall 3 side.

Therefore, as shown in FIG. 10, the shoulder 18 rests on the counter-shoulder 19. In the preferred embodiment illustrated, the upper rim 14 is coupled to an annular region 20 of the coupling portion 15 which is located between the counter-shoulder 19 and the upper edge 5 of the first side wall 4 to which the lid 6 is fixed. Therefore, advantageously, in the preferred embodiment, the basket-shaped filtering body 9 is in contact with the outer body 2 of the capsule 1, and in particular with the coupling portion 15, substantially at two annular portions of the first rigid or semi-rigid skeleton 10, one corresponding to the upper rim 14 and another corresponding to the shoulder 18. In particular, the contact between the shoulder 18 and the counter-shoulder 19 allows the filtering body 9, once inserted in the capsule 1 outer body 2, to stop at the counter-shoulder 19. In other words, the counter-shoulder 19 acts as a contact element which prevents the filtering body 9 from being subject to further movements towards the lower wall 3 of the capsule 1. That is particularly useful for keeping the filtering body 9 in a predetermined position, as described in more detail below.

In contrast, in the case of the embodiments in FIGS. 13 to 15, the coupling between the filtering body 9 and the coupling portion 15 is made by the rim 14 and a portion of the side wall 4 which in radial section is "C"- or "S"-shaped operating in conjunction with one another. Again in this case, it is a known hooking method, which therefore is not described in further detail.

However the coupling is created between the filtering body 9 and the coupling portion 15, the filtering body 9 may be advantageously coupled to the coupling portion 15 by mechanical interference, and in addition or alternatively, forms a sealed contact with it, where "sealed contact" in this context advantageously refers to a contact which is watertight. Moreover, the sealed contact may also be useful during capsule 1 production. In fact, during insertion of the powdered food substance in the first compartment 16, a sealed contact (at the coupling portion 15) allows a guarantee that the powder cannot accidentally be poured into the second compartment 17 (which would compromise use of the capsule 1 for making the beverage).

The coupling which uses mechanical interference and/or is sealed can be made in various ways.

In the embodiment illustrated in the detail in FIG. 10, the mechanical interference coupling is created between the upper rim 14 of the filtering body 9 and the above-mentioned annular region 20 of the coupling portion 15. To show the mechanical interference, in FIG. 10 the upper rim 14 is drawn partly overlapping the annular region 20, In particular, that representation implies that the interference contact which occurs between the upper rim 14 and the annular region 20 in reality, advantageously, requires at least one of these to be in a state of deformation (advantageously elastic). Mechanical interference may, in fact, preferably occur thanks to the elastic deformability of the upper rim 14 and/or of the annular region 20, the elasticity advantageously being allowed by the material used to make them and/or by their shape. In the embodiment illustrated the annular region 20, that is to say, the region of the coupling portion 15 located between the counter-shoulder 19 and the upper edge 5, is advantageously able to bend. In particular, the annular region 20 presses against the upper rim 14 of the filtering body 9 thanks to the elastic deformation to which it is subjected. As shown in FIG. 10, the annular region 20, seen in axial section, also extends at an angle relative to the axis of extension 8: in particular proceeding from the upper edge 5 towards the lower wall 3 the annular region 20 moves away from the axis of extension 8. Moreover, the coupling portion 15 at the upper edge 5 or at the part of the annular region 20 adjacent to the upper edge 5, delimits a section, perpendicularly to the axis of extension 8, which is advantageously less than the area delimited by the upper rim 14 also in the plane perpendicular to the axis of extension 8. Advantageously, for that reason, during capsule 1 production the coupling portion 15, and in particular in the preferred embodiment its annular region 20, resists the passage of the upper rim 14 during the end step of filtering body 9 insertion in the chamber 7. Filtering body 9 insertion in the chamber 7 therefore requires pressure to be applied on the filtering body 9, directed towards the lower wall 3, at least as the upper rim 14 passes at the annular region 20. In the preferred embodiment illustrated, advantageously, the pressure on the filtering body 9 is applied until the shoulder 18 is resting against the counter-shoulder 19, thus creating a snap-on type insertion. That particular shape of the coupling portion 15 and its interaction with the filtering body 9, and in particular with the upper rim 14, advantageously prevents removal of the filtering body 9 from inside the capsule 1 outer body 2, for example after a thrust applied on the bottom portion 12 of the filtering body 9 and directed towards the lid 6.

In contrast, in the case of the embodiments in FIGS. 13 to 15, sealed hooking may be achieved by making the diameter of the first rigid or semi-rigid skeleton 10 slightly larger than that of the annular region 20 of the "C"- or "S"-shaped coupling portion and forcing the coupling by means of a slight deformation of the side wall 4, in such a way as to engage the rim 14 either inside the annular region 20 or below it.

Therefore, advantageously, the sealed contact is also created between the rim 14 of the filtering body 9 and the annular region 20 of the coupling portion 15. In particular, in the embodiments illustrated, the rim 14 and the annular region 20 are made in such a way that between them there is continuous contact, and the seal is guaranteed by mechanical interference.

As already indicated, to avoid contact with the piercing element as it penetrates the second compartment 17 (if the lower wall 3 can be pierced), the filtering body 9 will advantageously have a shape that allows the piercing element to enter but at the same time avoids contact with it, considering its dimensions, the related stroke and its positioning.

Advantageously, in the preferred embodiments illustrated, that is achieved thanks to the fact that the filtering body 9 (or its bottom portion 12 if present) is separated (distant) from the lower wall 3 to allow, during capsule 1 use in a system suitable for using it, insertion of the piercing element in the capsule 1, through the lower wall 3, without the filtering body 9 being damaged. Moreover, if present, the bottom portion 12 of the filtering body 9 is preferably mainly constituted of a substantially flat disk.

In the embodiment illustrated in FIGS. 1 and 10, the position of the counter-shoulder 19 on the coupling portion 15 and the position of the shoulder 18 on the filtering body 9, are established to determine a distance between the lower wall 3 of the outer body 2 and the bottom portion 12 of the filtering body 9 which is greater than the distance between the tip of the piercing element and the lower wall 3 when the piercing element is inserted in the capsule 1.

Alternatively, the bottom portion 12 may comprise a recess 21 towards the lid 6 in which the piercing element can be inserted. The dimensions of the recess 21 will be proportionate to those of the piercing element and to the related stroke that it must cover inside the capsule 1 (the distance between the lower wall 3 and the tip of the piercing element, when the latter is inserted in the capsule 1). Depending if the piercing element passes through the lower wall 3 centrally or off-centre, the recess 21 will be located respectively at the centre or off-centre relative to the axis of extension 8, in the latter case having an extension that is advantageously annular about it. This configuration is illustrated in FIG. 4 where the bottom portion 12 comprises an outer annular zone 22 and an inner zone 23; the outer annular zone 22 being separated from the lower wall 3, whilst the inner zone 23 is close to the lower wall 3.

Alternatively to the presence of an annular recess 21 (therefore when the piercing element is off-centre relative to the axis of extension 8), the filtering body 9 may have a substantially conical shape, the taper being such that it prevents contact with the piercing element even when it is completely inserted (considering its maximum stroke) in the second compartment 17.

Again with reference to the shape of the filtering body 9, in the embodiments in FIGS. 1 to 12, as already indicated, the top of it is in contact with the first side wall 4 at the coupling portion 15. In contrast, the bottom of the filtering body 9 is separated from the first side wall 4, that is to say, between the first side wall 4 of the outer body 2 and the second side wall 11 of the filtering body 9 there is an empty space which corresponds to the part of the second compartment 17 positioned between the first side wall 4 and the filtering body 9. Advantageously, the distance between the filtering body 9 and the first side wall 4 at the second compartment 17 increases proceeding towards the bottom portion 12. For example, if the first side wall 4 extends in a substantially conical fashion with reference to the axis of extension 8, proceeding from the lid 6 towards the lower wall 3, the second side wall 11 of the filtering body 9 may have a similar extension but with a more pronounced taper (FIG. 1).

Moreover, in the embodiments illustrated in FIGS. 1 to 12, the second side wall 11 of the filtering body 9 has the structure of superposed rings 24, which are concentric about the axis of extension 8 and connected to each other. Each ring 24, proceeding from the upper rim 14 towards the bottom portion 12 of the filtering body 9, delimits a respective section of the first compartment 16, in a plane substantially perpendicular to the axis of extension 8, having an area greater than that delimited by the next ring 24. Advantageously, in the embodiment illustrated in FIG. 1, the same ring 24 delimits various sections of the first compartment 16 (which are perpendicular to the axis of extension 8) which have decreasing areas proceeding in the direction from the upper rim 14 towards the bottom portion 12. In other words, each ring 24, proceeding from the upper rim 14 towards the bottom portion 12, moves closer to the axis of extension 8. In the preferred embodiment illustrated in FIGS. 1 to 12, each section delimited by a ring 24 is substantially circular and its centre is identified by the intersection with the axis of extension 8. Said structure of the second side wall 11 of the first rigid or semi-rigid skeleton 10 gives it rigidity and makes its production easier, which advantageously can be carried out using injection moulding.

The second side wall 11, seen in radial section relative to the axis of extension 8, therefore comprises, on the side facing towards the first compartment 16, a substantially stepped profile, each step corresponding to one of the rings 24. Advantageously, even on the side facing towards the first side wall 4 the second side wall 11 of the filtering body 9 comprises a stepped profile, each step radially recessed, with reference to the axis of extension 8, relative to the adjacent step positioned between it and the upper rim 14. In other words, the second side wall 11 of the basket-shaped filtering body 9 comprises inner steps, formed by the rings 24, and outer steps, facing towards the first side wall 4. As shown in FIG. 1, the inner steps and the outer steps may not be aligned with each other. In particular, in the first embodiment each outer step extends substantially from approximately half the height, measured parallel to the axis of extension 8, of each ring 24. However, in other embodiments, other second side wall 11 configurations and structures are possible, such as those schematically illustrated in FIGS. 2, 3 and 4.

In the first embodiment the filtering body 9 also comprises ribs 25 for stiffening it which, advantageously, are located at least on the second side wall 11 of the first rigid or semi-rigid skeleton 10. As shown in FIG. 1, advantageously, the ribs 25 of the second side wall 11 extend longitudinally from the upper rim 14 at least to the bottom portion 12 and lie substantially in planes passing through the axis of extension 8. Preferably, the ribs 25 also extend on the bottom portion 12. In the first embodiment illustrated, more precisely, some ribs 25 extend over radial stretches (with reference to the axis of extension 8) on the bottom portion 12 whilst other ribs 25 extend over annular stretches about the axis of extension 8. The ribs 25 with annular extension and radial extension may meet one another, as shown in FIG. 1. Some ribs 25 of the bottom portion 12 which extend radially may also extend from the ribs 25 of the second side wall 11.

In the embodiment illustrated, the ribs 25 of the second side wall 11 extend on the rings 24 and on the outer steps in which the second side wall 11 is structured and they project radially relative to the latter, creating an overall frusto-conical shape: in other words, each rib 25 is angled in such a way that, proceeding from the upper rim 14 towards the bottom portion 12 of the filtering body 9, the distance between its outer surface and the capsule 1 axis of extension 8 is reduced.

In the preferred embodiment the ribs 25 do not make contact with the capsule 1 outer body 2, except at the coupling portion 15. However, in general the filtering body 9 may be in contact with the capsule 1 outer body 2 even at points other than the coupling portion 15, such as the outer surfaces of the ribs 25, provided that there is no interruption in the fluid communication both through the filtering body 9 and with the beverage outfeed zone through the lower wall 3. Therefore, in some embodiments, one or more of the ribs 25 present on the second side wall 11 and/or on the bottom portion 12 may be in contact with the capsule 1 outer body 2: for example the longitudinal ribs 25 present on the second side wall 11 could be in contact at one or more points with the first side wall, whilst between one rib 25 and another the filtering body 9 is spaced from the first side wall 4.

As already indicated, the first rigid or semi-rigid skeleton 10 comprises openings 13 which allow fluid communication, that is to say which allow the passage of the beverage from the first compartment 16 towards the second compartment 17.

In the embodiments in FIGS. 1 to 12, as already indicated, the openings 13 are located at least on the second side wall 11. Moreover, there are several openings 13 on each of the rings 24 of the first rigid or semi-rigid skeleton 10. In the embodiments illustrated, in particular, the openings 13 made in the second side wall 11 are formed by slits extending mainly parallel to the axis of extension 8, being arranged side by side. As shown in the accompanying drawings, FIGS. 2 to 4, the slits extend substantially over the entire height of each ring 24 (and therefore of each inner step). In contrast, in the first and second embodiments, each through slit only extends over a portion of each ring 24.

As already indicated, the openings 13 are advantageously also made in the bottom portion 12 (which mainly has the shape of a flat disk). In the embodiments illustrated, said openings 13 are elongate slots extending on the bottom portion 12 in directions which are radial relative to the axis of extension 8.

However, more generally, whatever the shape of the filtering body 9 and wherever the openings 13 are positioned, they may have a different shape, orientation, arrangement and dimensions, for example, they may be circular holes, or cross-shaped, elongate slits, curves, etc. Moreover, the first rigid or semi-rigid skeleton 10 may comprise different types of openings 13.

Finally, in accordance with the main innovative aspect of this invention, the filtering body also comprises an additional filtering element 26 positioned in the chamber 7 between the filtering body 9 and the lower wall 3 for intercepting all of the beverage which comes out of the filtering body 9 and flows towards the lower wall 3. The additional filtering element 26 is coupled to the inner part of the outer body 2, advantageously at the first side wall 4.

The additional filtering element 26 in general comprises at least one layer 27 of flexible filtering material, but may also comprise more than one. Said flexible filtering material may, for example, be non-woven fabric, fabric, paper, etc.

In the simplest embodiment (FIGS. 1 and 2) the additional filtering element 26 is constituted only of the one or more layers 27 of flexible filtering material which are directly fixed at their periphery to the outer body 2 (as illustrated 27 for example in FIG. 2). Said fixing may advantageously be achieved by sealing or gluing.

Figure 16:
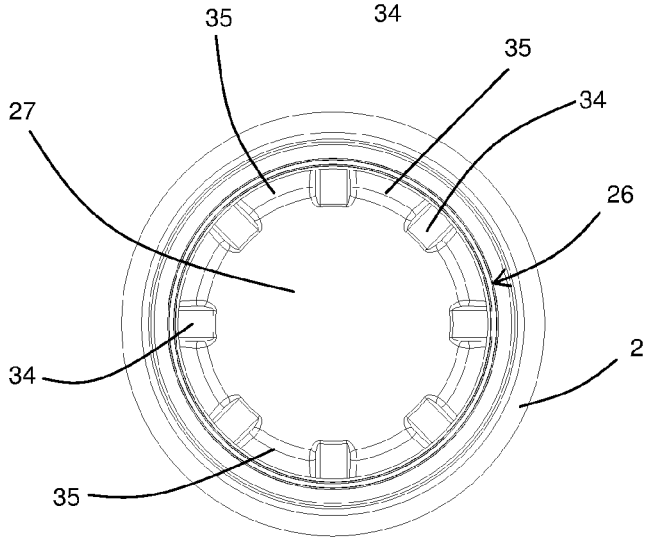
FIG. 16 is a top view, not in cross-section, of the capsules of FIG. 15, with some parts cut away to better illustrate others.

The one or more layers 27 of flexible filtering material are sealed or glued to the inner part of the outer body 2 along an annular path extending around the axis of extension 8. Advantageously, the one or more layers 27 of flexible filtering material are sealed or glued along their peripheries and/or to the first side wall 4. Moreover, depending on requirements, the one or more layers 27 of flexible filtering material may be sealed or glued along the annular path, either continuously and in a sealed fashion (as in FIGS. 1 to 10), or in a non-continuous fashion (FIGS. 12 to 16). In the latter case, along the annular path sealing or gluing zones 34 alternate with simple contact zones 35 between the additional filtering element 26 and the inner part of the outer body 2, as shown in FIG. 16.

In fact, it should be noticed that, for certain particle sizes and for relatively large quantities of substance, it has been observed that non-continuous sealing or gluing of the additional filtering element 26 allows a reduction in dispending times, but still guarantees optimum filtering.

The dimensions of the sealing or gluing zones 34 and of the simple contact zones 35 may vary according to requirements. However, in the preferred embodiments, with reference to the axis of extension 8, the sum of the angles subtended by the simple contact zones 35 and the sum of the angles subtended by the sealing or gluing zones 34, are in a proportion to each other of between 1:20 and 20:1.

Moreover, in some preferred embodiments, each simple contact zone 35 has a length not greater than 10 to 15 mm (advantageously that refers to the maximum length measured along a straight line from its starting point to its end point).

Moreover, advantageously, the zones 34, 35 of the same type are all of equal length and are evenly distributed along the annular path.

Moreover, in the preferred embodiment, the additional filtering element 26 comprises an outer radial face 36 formed by the thickness of the one or more layers 27 of flexible filtering material of which it is constituted, said face, at least at the simple contact zones 35, facing and resting on the inner surface of the outer body 2. Even more advantageously, the inner surface of the outer body 2 compresses the additional filtering element 26 at the outer radial face 36, giving it a rounded configuration. That may be achieved for example by sizing the additional filtering element 26 so that it is slightly larger than the cross-section of the outer body 2 at the additional filtering element 26 and forcing the latter into position.

In contrast, in other embodiments, the additional filtering element 26 comprises a second rigid or semi-rigid skeleton 28 forming one or more passages 29 for the beverage through it. In this case, one or more layers 27 of flexible filtering material are applied at the one or more passages 29 to close them and therefore intercept the beverage which passes through them.

In these embodiments, advantageously it is the second rigid or semi-rigid skeleton 28 which is constrained to the outer body 2 and, more particularly, to the first side wall 4. Advantageously, fixing of the second rigid or semi-rigid skeleton 28 to the first side wall 4 can be achieved by gluing, sealing or mechanical interference (particularly preferred solution—FIG. 3).

Figure 5:
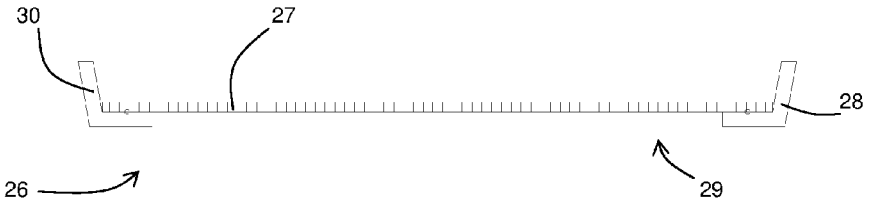
FIG. 5 shows a detail of the capsule of FIG. 3.
Figure 6:
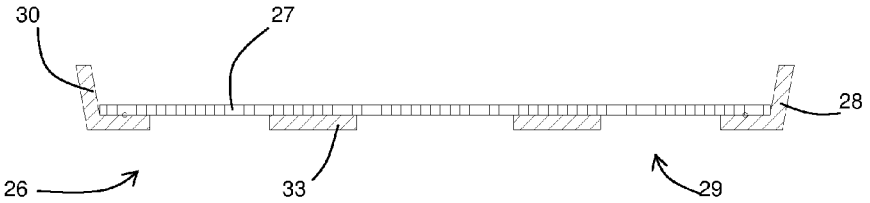
FIGS. 6 to 9 show several possible alternative embodiments of the detail of FIG. 5.

FIGS. 5 to 9 shows different possible embodiments of the second rigid or semi-rigid skeleton 28. In FIG. 5 it is exclusively an annular element 30 with L-shaped cross-section which forms a single passage 29, and the flexible filtering material is fixed above it. In FIG. 6, in contrast, in addition to the annular element 30 the second rigid or semi-rigid skeleton 28 comprises transversal elements 33 which are connected to the annular element 30 (advantageously they form a single piece with it) which divide the passage 29 delimited by the annular element 30 into smaller passages 29. Again in this case, the flexible filtering material is fixed above the annular element 30 and the transversal elements 33.

Figure 7:
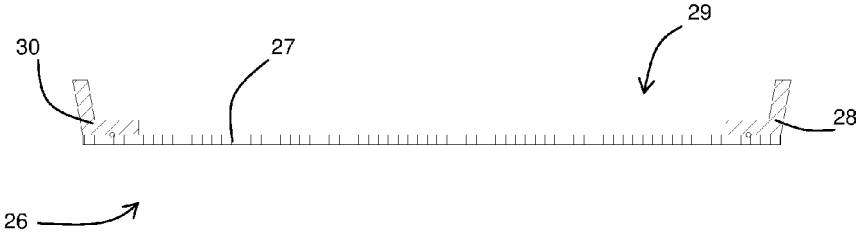
Figure 8:
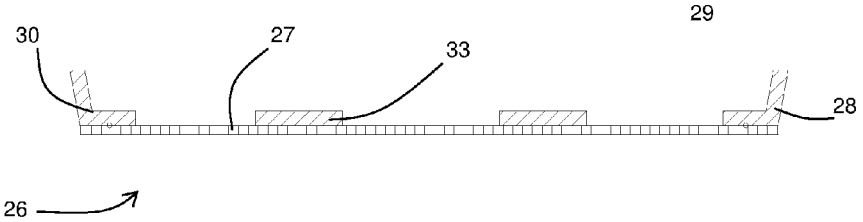

In contrast, in FIGS. 7 and 8 the second skeleton 28 is similar respectively to that of FIGS. 5 and 6, but the flexible filtering material is fixed below it.

Figure 9:
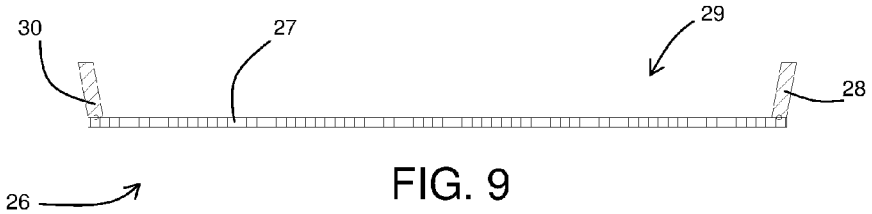

Finally, FIG. 9 shows a solution similar to that of FIG. 5 but with the annular element 30 constituted only of a band of material, not having an "L" shape.

Similarly to what is the case for the filtering body 9, the additional filtering element 26 is also separated from the lower wall 3 to allow, during capsule 1 use in a system suitable for using it, insertion of the piercing element in the capsule 1, through the lower wall 3, without the additional filtering element being damaged. Consequently, when the filtering body is spaced from the lower wall, so is the additional filtering element 26, whilst when the bottom portion 21 of the filtering body 9 comprises a recess 21, it may advantageously be the case that the additional filtering element 26 (with or without the second rigid or semi-rigid skeleton 28) is shaped in a similar way to the bottom portion 12 as shown 27 in FIG. 4. In this way, during use, insertion of a piercing element in the capsule 1, through the lower wall, can occur without the additional filtering element 26 being damaged.

In contrast, in other embodiments, the piercing element may also make contact with the additional filtering element 26 after making a hole in the lower wall (even deforming it/shifting it towards the lower portion 21), provided that this does not damage the additional filtering element 26.

It should also be noticed that, in some embodiments the first rigid or semi-rigid skeleton 10 and the second rigid or semi-rigid skeleton 28 may be rigidly connected to form a single piece.

In all of the embodiments illustrated, the flexible filtering material is applied to the second rigid or semi-rigid skeleton 28 in a single piece. However, in other embodiments not illustrated, the flexible material may instead be used in a plurality of smaller pieces, each fixed to the second rigid or semi-rigid skeleton 28 at one or more passages 29.

Fixing of the flexible filtering material to the second rigid or semi-rigid skeleton 28 can advantageously be achieved in any way suitable for the purpose, for example by sealing, gluing, or moulding the second rigid or semi-rigid skeleton 28 directly on the layer 27 of material.

However, in general, advantageously fixing of the flexible filtering material to the second rigid or semi-rigid skeleton 28 occurs for each piece along a line which surrounds one or more passages 29. In general, fixing of the one or more layers 27 of flexible filtering material to the second rigid or semi-rigid skeleton 28 may occur in a similar way to that described above relative to fixing directly to the outer body 2. Therefore, along each line the fixing may be continuous in such a way as to prevent the formation of routes which may allow the beverage to go from the openings 13 to the lower wall 3 without passing through the at least one layer 27 of flexible filtering material, or non-continuous, alternating glued or sealed zones with simple contact zones 35.

In general, to allow easier positioning of the additional filtering element 26, the first side wall 4 comprises, close to the lower wall 3 but spaced from it, a folded portion 31 defining in the chamber 7 an annular surface 32 extending inwards towards the axis of extension 8. The additional filtering element 26 is positioned/fixed on said annular surface 32.

Although thanks to the presence of the additional filtering element 26 in theory the openings 13 could have a shape and/or be of a size such that they allow the passage 29 of the powdered food substance through them (but at that point there would no longer be a filtering body), in contrast, in the preferred embodiments that is not the case and all of the openings 13 are of a size such that they act as a filter for the powdered food substance, to retain it at least when it is larger than a predetermined particle size (the size of the openings usually being less than the nominal size of the powdered substance).

Figure 17:
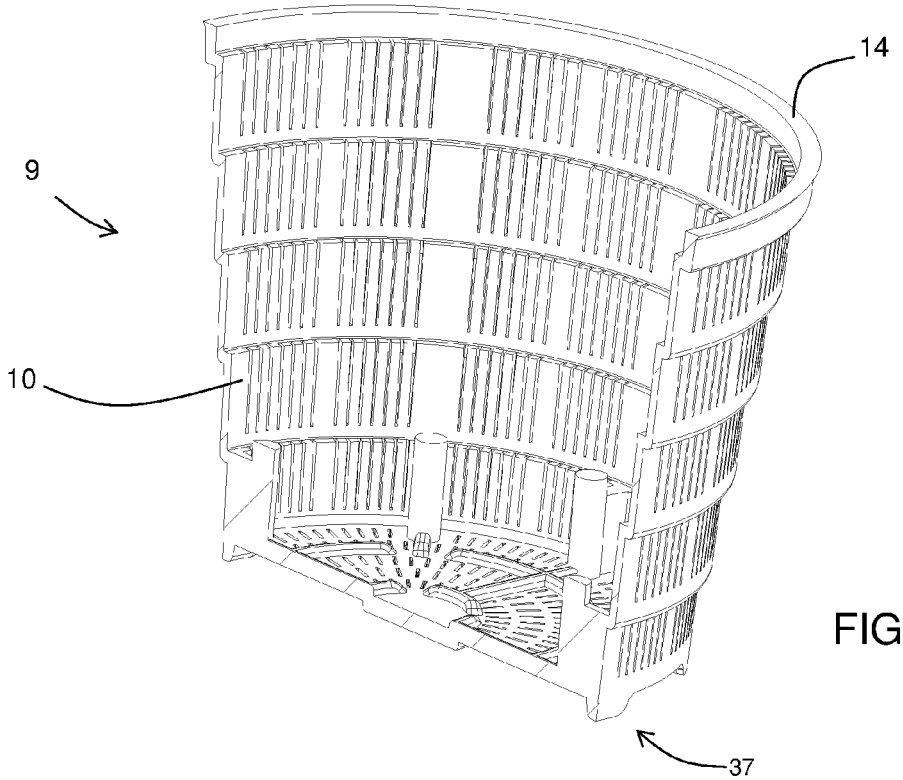
FIG. 17 is a schematic axonometric view of an alternative embodiment of a filtering body usable in one of the capsules of FIGS. 1 to 12, in cross-section along a vertical middle plane.
Figure 18:
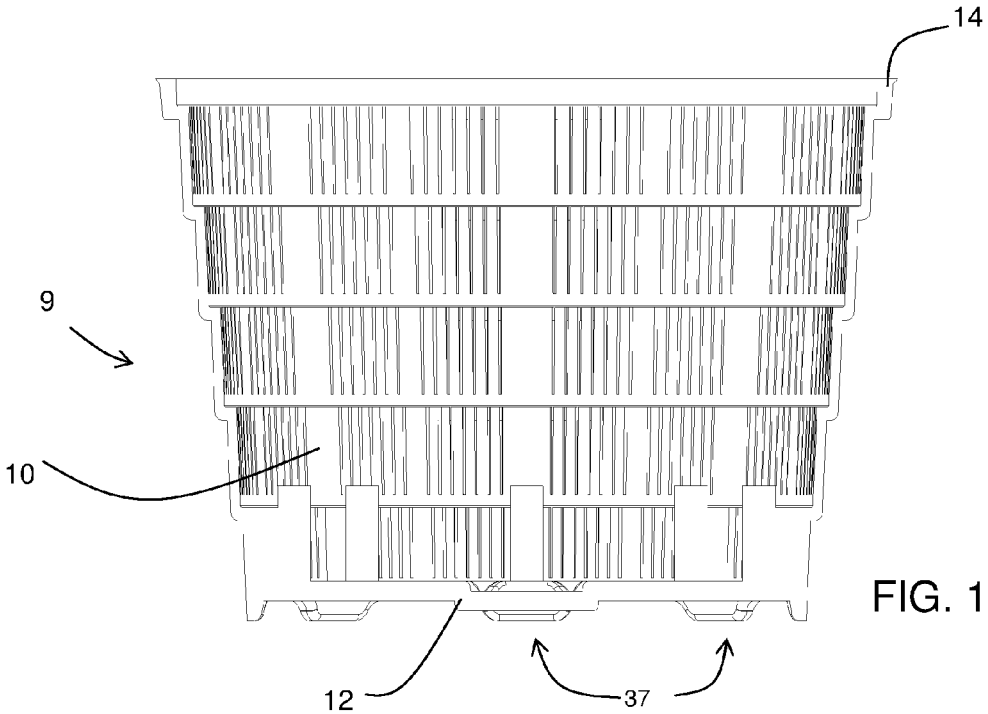
FIG. 18 is a front view of the filtering body of FIG. 17.

Depending on requirements, in the assembled capsule 1, the filtering body 9 may or may not be in contact with the additional filtering element 26. If the two are in contact, preferably the filtering body 9 comprises a resting portion constituted of a plurality of projecting teeth 37 alternating with non-projecting zones, as illustrated in FIGS. 17 and 18, relative to a basket-shaped filtering body 9. In fact, in this way, it is possible to achieve non-continuous contact between the two and therefore to guarantee that the flow of beverage coming out of the openings 13 made in the second side wall 11 can reach any part of the additional filtering element 26, making full use of its potential.

As indicated, the capsule 1 is suitable for use in a capsule-based beverage making system which comprises water injecting means that can be associated with the lid 6 of the capsule 1 and beverage extracting means which can be associated with the lower wall 3 of the capsule 1. In particular, in the preferred embodiment, an injecting element which pierces the lid 6 is used to inject the water into the first compartment 16 which contains the powdered food substance. The water interacts with the powdered food substance, making the beverage which, driven by the water flow (which may be pressurised), passes through the powder, covering stretches of it until it reaches the openings 13 present in the filtering body 9. While the powdered food substance at least mainly remains confined in the first compartment 16, the beverage passes through the openings 13 from the first compartment 16 to the second compartment 17, where it can come out of the capsule 1 after the action of the piercing element which penetrates the lower wall 3. Depending on the type of beverage making system, the beverage may come out through the hole left by the piercing element or through a channel present in said element.

Any granules of powder which manage to pass beyond the openings 13 are then intercepted and retained by the additional filtering element 26. However, unlike what happens in prior art capsules equipped with filters made of flexible filtering material, in the preferred embodiment in which said openings 13 are of a size such that they themselves act as a filter for the powdered food substance, to retain it at least when it is larger than a predetermined particle size, it is possible to avoid any clogging of the additional filtering element 26 since most of the powdered substance is retained directly by the first rigid or semi-rigid skeleton 10.

This invention brings important advantages.

First, the use of an additional filtering element equipped with one or more layers of flexible filtering material allows a reduction, or even elimination, of micro-granules of powder coming out with the beverage even should a certain quantity should manage to pass beyond the filtering body.

Second, non-continuous gluing or sealing of the additional filtering element allow a limit to be put on the time required for dispensing the beverage even in the case of capsules containing relatively large quantities of powdered substance.

Furthermore, the basket shape of the filtering element and the presence of the openings in the second side wall also allow a reduction in the average distance that the water must cover through the powdered food substance in order to be able to come out of the filtering body. For example, the beverage made close to the lid is not forced to pass through substantially all of the powdered food substance in order to be able to come out through the bottom portion of the filtering body, but can come out through the above-mentioned openings closest to it. In that way, the beverage encounters less resistance during its movement. Moreover, in that way, the risk of the formation of highly compacted areas linked to the substantially unidirectional flow of water and beverage is reduced. In this way, while the beverage is being made the powdered food substance maintains substantially even compactness, consequently reducing the risk of the formation of preferential water flow channels, and the water can therefore permeate the food substance more evenly and homogeneously, leading to an increase in the quality of the beverage made.

Added to that is the fact that the basket-shaped filtering body, thanks to its shape and the presence of the above-mentioned openings, comprises a filtering surface greater than that of a common flat filtering body (the dimensions of the capsule being the same), while keeping the quantity of powdered food substance contained in it substantially unchanged. That allows improved filtering of the beverage.

Finally, it should be noticed that this invention is relatively easy to produce and that even the cost linked to implementing the invention is not very high.

The invention described above may be modified and adapted in several ways without thereby departing from the scope of the inventive concept.

Moreover, all details of the invention may be substituted with other technically equivalent elements and the materials used, as well as the shapes and dimensions of the various components, may vary according to requirements.

The invention claimed is:

1. A capsule for making beverages comprising at least one powdered food substance which can be extracted by passing water through the powdered food substance to make a beverage, comprising:

a substantially cup-shaped outer body which in turn comprises a lower wall and a first side wall;

a lid fixed to the outer body at an upper edge of the first side wall located on the opposite side to the lower wall, between said lid and the inner surface of the outer body there also being a chamber and between a central point of the lid and a central point of the lower wall there being a capsule axis of extension;

a filtering body comprising a first rigid or semi-rigid skeleton positioned in the chamber and comprising a substantially annular rim; said first rigid or semi-rigid skeleton comprising openings to allow fluid communication through the first skeleton;

the rim being coupled to the outer body at a substantially annular coupling portion of the first side wall, and the filtering body dividing the chamber into a first compartment positioned at least between the filtering body and the lid, inside which the powdered food substance is received, and into a second compartment positioned at least between the filtering body and the lower wall;

the capsule also comprising an additional filtering element positioned in the chamber between the filtering body and the lower wall for in use intercepting the beverage which comes out of the filtering body and flows towards the lower wall, the additional filtering element comprising at least one layer of flexible filtering material and being coupled to the inner part of the outer body.

2. The capsule according to claim 1, wherein the additional filtering element is constituted of one or more layers of flexible filtering material which are sealed or glued to the inner part of the outer body.

3. The capsule according to claim 2, wherein the one or more layers of flexible filtering material are sealed or glued continuously to the inner part of the outer body along an annular path extending around the axis of extension.

4. The capsule according to claim 2, wherein the one or more layers of flexible filtering material are sealed or glued intermittently to the inner part of the outer body along an annular path extending around the axis of extension, along the annular path there being alternating sealing or gluing zones and simple contact zones between the additional filtering element and the inner part of the outer body.

5. The capsule according to claim 4, wherein with reference to the axis of extension, the sum of the angles subtended by the simple contact zones and the sum of the angles subtended by the sealing or gluing zones are in a proportion to each other of between 1:20 and 20:1.

6. The capsule according to claim 4, wherein the length of each simple contact zone, measured along a straight line, is not greater than 10-15 mm.

7. The capsule according to claim 4, wherein the additional filtering element comprises an outer radial face formed by the thickness of the one or more layers of flexible filtering material, said face, at least at the simple contact zones, facing and resting on the inner surface of the outer body.

8. The capsule according to claim 2, wherein the one or more layers of flexible filtering material are sealed or glued intermittently to the inner part of the outer body along an annular path extending around the axis of extension, along the annular path there being alternating sealing or gluing zones and simple contact zones between the additional filtering element and the inner part of the outer body, wherein the additional filtering element comprises an outer radial face formed by the thickness of the one or more layers of flexible filtering material, said face, at least at the simple contact zones, facing and resting on the inner surface of the outer body, and wherein the inner surface of the outer body compresses the additional filtering element at the outer radial face giving the additional filtering element a rounded configuration.

9. The capsule according to claim 2, wherein the one or more layers of flexible filtering material are sealed or glued peripherally and/or to the first side wall.

10. The capsule according to claim 2, wherein the first side wall comprises, close to the lower wall but spaced from the lower wall, a folded portion defining in said chamber an annular surface extending inwards towards the axis of extension, on which the additional filtering element is positioned.

11. The capsule according to claim 2, wherein the openings are of a size such that they act as a filter for the powdered food substance and substantially retain the powdered food substance while allowing the beverage to pass.

12. The capsule according to claim 2, wherein the filtering body is coupled to the coupling portion by mechanical interference and/or forms a sealed contact with the coupling portion.

13. The capsule according to claim 2, wherein the filtering body and the additional filtering element are at least partly separated from the lower wall to allow, during use, insertion of a piercing element in the capsule, through the lower wall, without damaging the filtering body and the additional filtering element.

14. The capsule according to claim 2, wherein the lower wall is pierceable during use to allow the beverage to come out of the capsule, and in that, during use, a piercing element may be inserted between the additional filtering element and the outer body without damaging the additional filtering element, after penetrating the lower wall.

15. The capsule according to claim 2, wherein:

the first rigid or semi-rigid skeleton is basket-shaped, contains the powdered food substance, and comprises a second side wall the bottom of which is connected to a bottom portion, said rim being an upper rim of the second side wall;

the upper rim is positioned close to the lid of the capsule;

the coupling portion is positioned close to the upper edge of the first side wall;

the bottom portion is positioned close to the lower wall of the outer body;

the second side wall is at least partly spaced from the first side wall to allow the beverage to flow towards the lower wall; and the openings are made at least through the second side wall, and the openings through the second side wall are made at least at the part of the second side wall which is spaced from the first side wall.

16. The capsule according to claim 2, characterised in that the filtering body is in contact with the additional filtering element and in that the filtering body comprises a resting portion constituted of a plurality of projecting teeth alternating with non-projecting zones in such a way as to guarantee non-continuous contact with the additional filtering element.

17. The capsule according to claim 2, characterised in that, at least during use, liquid communication between the second compartment and the lid is only possible through the first compartment.

18. The capsule according to claim 1, wherein the additional filtering element comprises a second rigid or semi-rigid skeleton forming one or more passages for the beverage through the second skeleton where one or more layers of flexible filtering material are fixed, said second rigid or semi-rigid skeleton being constrained to the first side wall.

19. The capsule according to claim 18, wherein the one or more layers of flexible filtering material are sealed or glued continuously to the second rigid or semi-rigid skeleton along one or more lines surrounding the one or more passages.

20. The capsule according to claim 18, wherein the one or more layers of flexible filtering material are sealed or glued intermittently to the second rigid or semi-rigid skeleton and along one or more lines surrounding the one or more passages, along the one or more lines there being alternating sealing or gluing zones and simple contact zones between the additional filtering element and the second rigid or semi-rigid skeleton.

21. The capsule according to claim 20, wherein with reference to a central axis relative to the one or more passages, the sum of the angles subtended by the simple contact zones and the sum of the angles subtended by the sealing or gluing zones are in a proportion to each other of between 1:20 and 20:1.

22. The capsule according to claim 20, wherein the length of each simple contact zone, measured along a straight line, is not greater than 10-15 mm.

23. The capsule according to claim 18, wherein the first side wall comprises, close to the lower wall but spaced from the lower wall, a folded portion defining in said chamber an annular surface extending inwards towards the axis of extension, on which the additional filtering element is positioned.

24. The capsule according to claim 18, wherein the openings are of a size such that they act as a filter for the powdered food substance and substantially retain the powdered food substance while allowing the beverage to pass.

25. The capsule according to claim 18, wherein the filtering body is coupled to the coupling portion by mechanical interference and/or forms a sealed contact with the coupling portion.

26. The capsule according to claim 18, wherein the filtering body and the additional filtering element are at least partly separated from the lower wall to allow, during use, insertion of a piercing element in the capsule, through the lower wall, without damaging the filtering body and the additional filtering element.

27. The capsule according to claim 18, wherein the lower wall is pierceable during use to allow the beverage to come out of the capsule, and in that, during use, a piercing element may be inserted between the additional filtering element and the outer body without damaging the additional filtering element, after penetrating the lower wall.

28. The capsule according to claim 18, wherein:

the first rigid or semi-rigid skeleton is basket-shaped, contains the powdered food substance, and comprises a second side wall the bottom of which is connected to a bottom portion, said rim being an upper rim of the second side wall;

the upper rim is positioned close to the lid of the capsule;

the coupling portion is positioned close to the upper edge of the first side wall;

the bottom portion is positioned close to the lower wall of the outer body;

the second side wall is at least partly spaced from the first side wall to allow the beverage to flow towards the lower wall; and the openings are made at least through the second side wall, and the openings through the second side wall are made at least at the part of the second side wall which is spaced from the first side wall.

29. The capsule according to claim 18, characterised in that the filtering body is in contact with the additional filtering element and in that the filtering body comprises a resting portion constituted of a plurality of projecting teeth alternating with non-projecting zones in such a way as to guarantee non-continuous contact with the additional filtering element.

30. The capsule according to claim 18, characterised in that, at least during use, liquid communication between the second compartment and the lid is only possible through the first compartment.

31. The capsule according to claim 1, wherein the first side wall comprises, close to the lower wall but spaced from the lower wall, a folded portion defining in said chamber an annular surface extending inwards towards the axis of extension, on which the additional filtering element is positioned.

32. The capsule according to claim 31, characterised in that the filtering body is in contact with the additional filtering element and in that the filtering body comprises a resting portion constituted of a plurality of projecting teeth alternating with non-projecting zones in such a way as to guarantee non-continuous contact with the additional filtering element.

33. The capsule according to claim 31, characterised in that, at least during use, liquid communication between the second compartment and the lid is only possible through the first compartment.

34. The capsule according to claim 1, wherein the openings are of a size such that they act as a filter for the powdered food substance and substantially retain the powdered food substance while allowing the beverage to pass.

35. The capsule according to claim 34, characterised in that the filtering body is in contact with the additional filtering element and in that the filtering body comprises a resting portion constituted of a plurality of projecting teeth alternating with non-projecting zones in such a way as to guarantee non-continuous contact with the additional filtering element.

36. The capsule according to claim 34, characterised in that, at least during use, liquid communication between the second compartment and the lid is only possible through the first compartment.

37. The capsule according to claim 1, wherein the filtering body is coupled to the coupling portion by mechanical interference and/or forms a sealed contact with the coupling portion.

38. The capsule according to claim 37, characterised in that the filtering body is in contact with the additional filtering element and in that the filtering body comprises a resting portion constituted of a plurality of projecting teeth alternating with non-projecting zones in such a way as to guarantee non-continuous contact with the additional filtering element.

39. The capsule according to claim 37, characterised in that, at least during use, liquid communication between the second compartment and the lid is only possible through the first compartment.

40. The capsule according to claim 1, wherein the filtering body and the additional filtering element are at least partly separated from the lower wall to allow, during use, insertion of a piercing element in the capsule, through the lower wall, without damaging the filtering body and the additional filtering element.

41. The capsule according to claim 40, wherein:

the first rigid or semi-rigid skeleton is basket-shaped, contains the powdered food substance, and comprises a second side wall the bottom of which is connected to a bottom portion, said rim being an upper rim of the second side wall;

the upper rim is positioned close to the lid of the capsule;

the coupling portion is positioned close to the upper edge of the first side wall;

the bottom portion is positioned close to the lower wall of the outer body;

the second side wall is at least partly spaced from the first side wall to allow the beverage to flow towards the lower wall; and the openings are made at least through the second side wall, and the openings through the second side wall are made at least at the part of the second side wall which is spaced from the first side wall;

and wherein the bottom portion comprises an outer annular zone and an inner zone, the outer annular zone being separated from the lower wall to allow, during use, insertion of a piercing element in the capsule, through the lower wall, without the bottom portion of the filtering body being damaged, the inner zone in contrast being close to the lower wall, and wherein the additional filtering element is shaped in a similar way to the bottom portion.

42. The capsule according to claim 40, characterised in that the filtering body is in contact with the additional filtering element and in that the filtering body comprises a resting portion constituted of a plurality of projecting teeth alternating with non-projecting zones in such a way as to guarantee non-continuous contact with the additional filtering element.

43. The capsule according to claim 40, characterised in that, at least during use, liquid communication between the second compartment and the lid is only possible through the first compartment.

44. The capsule according to claim 1, wherein the lower wall is pierceable during use to allow the beverage to come out of the capsule, and in that, during use, a piercing element may be inserted between the additional filtering element and the outer body without damaging the additional filtering element, after penetrating the lower wall.

45. The capsule according to claim 44, characterised in that the filtering body is in contact with the additional filtering element and in that the filtering body comprises a resting portion constituted of a plurality of projecting teeth alternating with non-projecting zones in such a way as to guarantee non-continuous contact with the additional filtering element.

46. The capsule according to claim 44, characterised in that, at least during use, liquid communication between the second compartment and the lid is only possible through the first compartment.

47. The capsule according to claim 1, wherein:

the first rigid or semi-rigid skeleton is basket-shaped, contains the powdered food substance, and comprises a second side wall the bottom of which is connected to a bottom portion, said rim being an upper rim of the second side wall;

the upper rim is positioned close to the lid of the capsule;

the coupling portion is positioned close to the upper edge of the first side wall;

the bottom portion is positioned close to the lower wall of the outer body;

the second side wall is at least partly spaced from the first side wall to allow the beverage to flow towards the lower wall; and the openings are made at least through the second side wall, and the openings through the second side wall are made at least at the part of the second side wall which is spaced from the first side wall.

48. The capsule according to claim 47, wherein the second side wall is spaced from the first side wall at least along most of the second side wall's extension and/or wherein the distance between the second side wall and the first side wall increases proceeding from the upper rim towards the bottom portion.

49. The capsule according to claim 47, wherein close to the upper rim, the filtering body comprises a shoulder which is substantially annular about the axis of extension and which projects radially relative to the rest of the filtering body with reference to the axis of extension, and wherein the coupling portion comprises a counter-shoulder which is substantially annular about the axis of extension and also projects radially, with reference to the axis of extension, relative to the portion of first side wall adjacent to the counter-shoulder on the lower wall side, said shoulder resting on the counter-shoulder and said upper rim being coupled to an annular region of the coupling portion located between the counter-shoulder and the upper edge.

50. The capsule according to claim 47, characterised in that the bottom portion comprises a perimetric edge projecting towards the lower wall relative to the rest of the self-same bottom portion and resting on the additional filtering element, the perimetric edge having a notched profile in such a way as to guarantee non-continuous contact with the additional filtering element.

51. The capsule according to claim 47, characterised in that, at least during use, liquid communication between the second compartment and the lid is only possible through the first compartment.

52. The capsule according to claim 1, characterised in that the filtering body is in contact with the additional filtering element and in that the filtering body comprises a resting portion constituted of a plurality of projecting teeth alternating with non-projecting zones in such a way as to guarantee non-continuous contact with the additional filtering element.

53. The capsule according to claim 52, characterised in that, at least during use, liquid communication between the second compartment and the lid is only possible through the first compartment.

54. The capsule according to claim 1, characterised in that, at least during use, liquid communication between the second compartment and the lid is only possible through the first compartment.

* * * * *